US008708204B2

(12) United States Patent
Nystrom et al.

(10) Patent No.: US 8,708,204 B2
(45) Date of Patent: Apr. 29, 2014

(54) ARRANGEMENT FOR CONTROLLING THE FLOW OUT OF A TUNDISH

(75) Inventors: Ralph Nystrom, Sodra Sunderbyn (SE); Ulf Sjostrom, Lulea (SE)

(73) Assignee: Swerea Mefos AB, Lulea (SE)

( * ) Notice: Subject to any disclaimer, the term of this patent is extended or adjusted under 35 U.S.C. 154(b) by 57 days.

(21) Appl. No.: 13/261,299

(22) PCT Filed: Dec. 3, 2010

(86) PCT No.: PCT/SE2010/000282

§ 371 (c)(1),
(2), (4) Date: May 29, 2012

(87) PCT Pub. No.: WO2011/071431

PCT Pub. Date: Jun. 16, 2011

(65) Prior Publication Data

US 2012/0280003 A1 Nov. 8, 2012

(30) Foreign Application Priority Data

Dec. 8, 2009 (SE) ..... 0901533

(51) Int. Cl.
*B22D 41/08* (2006.01)

(52) U.S. Cl.
USPC ..... 222/602; 266/236

(58) Field of Classification Search
USPC ..... 222/590, 591, 598, 602; 266/236, 265, 266/271
See application file for complete search history.

(56) References Cited

U.S. PATENT DOCUMENTS

| | | | | |
|---|---|---|---|---|
| 3,083,422 | A * | 4/1963 | Finkl | 222/603 |
| 4,155,492 | A * | 5/1979 | Seaton | 222/592 |
| 5,004,130 | A | 4/1991 | Vaterlaus | |
| 5,083,689 | A * | 1/1992 | Vaterlaus | 222/602 |
| 5,185,300 | A * | 2/1993 | Hoggard et al. | 501/99 |
| 6,464,116 | B1 * | 10/2002 | Hanse | 222/602 |
| 6,913,730 | B2 * | 7/2005 | Moriarty et al. | 266/272 |

FOREIGN PATENT DOCUMENTS

| | | |
|---|---|---|
| SE | 528543 | 12/2006 |
| WO | WO 2005/042183 | 5/2005 |

* cited by examiner

*Primary Examiner* — Scott Kastler
*Assistant Examiner* — Michael Aboagye
(74) *Attorney, Agent, or Firm* — Mark P. Stone

(57) ABSTRACT

In continuous casting of steel, the flow out of the tap hole (11) in the tundish (10) is controlled by a stopper rod that is rotatable so as to give the molten steel a swirling motion. This rotation reduces the risk of deposits in the tap hole and in the discharge tube (12). A non-rotatable sleeve around the stopper rod (16) extends through the slag layer (18) and into the molten steel (17). Protective gas is supplied to the gap between the stopper rod (16) and the sleeve (30) to prevent air from being drawn through the gap and into the molten steel.

2 Claims, 1 Drawing Sheet

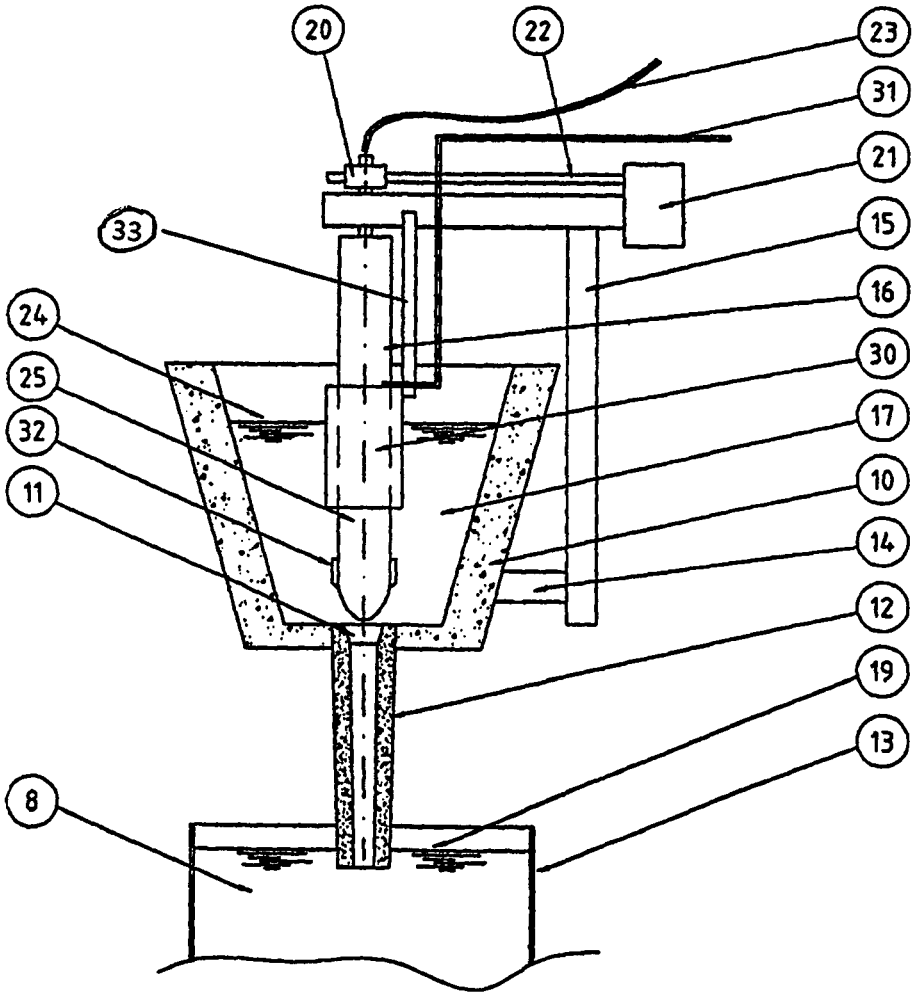
20
22
23
31
21
33
15
16
24
30
25
17
32
10
11
14
12
19
13
8

ARRANGEMENT FOR CONTROLLING THE FLOW OUT OF A TUNDISH

TECHNICAL FIELD

The invention relates to an arrangement for controlling the flow out of a tundish that has a tap hole for molten metal, usually for the continuous casting of steel, comprising an axially movable stopper rod for controlling the flow out of the tap hole and a device for rotating the stopper rod.

BACKGROUND OF THE INVENTION

In continuous casting of steel for casting a billet, slab or bloom, molten steel is poured from a ladle to a tundish and from the tundish to a cooled mould where the metal begins to solidify and continuously is withdrawn from the mould. The tap hole consists of a ceramic nozzle and the steel flows from the nozzle through a discharge tube that extends into the molten steel in the mould. The discharge tube keeps the flow together and protects it from the oxygen in the air. The outlet flow through the nozzle is usually controlled by means of a vertically movable stopper rod. SE 528543 discloses such a stopper rod arrangement that has means for rotating the stopper rod. The rotation of the stopper rod makes the molten steel rotate, and as a result, the impurities such as oxides and nitrides gather in the center of the outlet flow and will not contact the walls of the discharge tube. In this way, the risk of getting deposits on the walls of the mould is reduced as is the risk of orifice clogging. The nitrides and oxides that reach the mould will float as a slag layer on top of the molten metal or are drawn into the molten metal.

OBJECT OF INVENTION AND A BRIEF DESCRIPTION OF THE INVENTION

It is an object of the invention to reduce the amount of impurities that enters the mould from the tundish. This is achieved with a a sleeve around the stopper rod arranged to extend through the slag layer and down into the molten metal, and means for supply of protective gas to the annular gap between the stopper rod and the sleeve.

BRIEF DESCRIPTION OF THE DRAWING

FIG. 1 shows schematically a tundish and a mould and a stopper rod arrangement in accordance with the invention.

DETAILED DESCRIPTION OF THE DISCLOSED EXAMPLE OF THE INVENTION

The FIGURE shows a tundish 10 with a tap hole at its bottom in the form of a nozzle 11 and a discharge tube 12. The discharge tube extends into a cooled continuous casting mould 13. A mount 14 on the tundish carries an arrangement 15 with a stopper rod 16. The arrangement is vertically movable by power in the mount 14 for controlling the vertical position of the stopper rod, thereby to control the flow through the nozzle and to be able to close the nozzle completely. The device for moving the stopper rod arrangement is not shown.

The tundish is continuously charged with molten metal, usually steel, through a non illustrated tube from the controlled outlet of a ladle so that the level of molten metal 17 in the tundish will be comparatively constant. The stopper rod arrangement 15 is continuously controlled to control the molten metal flow out of the tundish and to keep the level 19 of the molten steel in the mould comparatively constant. A thin layer of slag floats on top of the molten metal. This layer of slag 24 prevents air from reaching the molten metal and prevents re-oxidation of the steel.

The stopper rod 16 is ceramic and it has a central steel tube 20 that extends above the ceramic. This tube 20 is rotatably mounted and the arrangement has a motor 21 for rotating the stopper rod via a transmission 22. The stopper rod should not rotate when it is is in engagement with the nozzle and keeps the nozzle closed. It should start to rotate as soon as it is raised from engagement with the nozzle in order to give the outlet flow a swirling motion. The motor 21 can be controlled by a position sensor which senses the position of the stopper rod indirectly by sensing the position of the entire arrangement. Alternatively, the transmission can have a sliding clutch to make the stopper rod stop its rotation when it seals against the nozzle. The stopper rod may have protrusions 32 at its lower portion for increasing the swirling motion of the molten steel.

The stopper rod arrangement has a sleeve 30 around the stopper rod and it extends from the space above the molten steel through the slag layer and down into the molten steel and it prevents slag from being pulled down into the molten steel. The sleeve is non-rotating and it can alternatively be directly carried by the tundish. As illustrated in the drawing, the non-rotating sleeve 30 is mounted to an overhead support by mounting element 33. A conduit 31 for protective gas leads to the annular gap so that a protective gas flow prevents air from being drawn into the gap around the stopper rod. Such air would cause re-oxidation of the molten steel.

A conduit 23 may be coupled for supplying protective gas to the central tube 20 of the stopper rod via a swivel and the lower portion of the stopper rod can have side outlets for the gas. Such gas supply will increase the swirling motion and the gas will increase the capacity of the slag layer to protect the molten steel from oxygen when the gas moves up from the molten steel to the slag layer.

The invention claimed is:

1. An arrangement for controlling flow of a tundish (10) that has a tap hole (11) for molten metal, said arrangement comprising an axially movable stopper rod (16) for controlling the flow out of the tap hole and a device (21, 22) for rotating the stopper rod;

a sleeve (30) non-rotatably mounted around the stopper rod (16) by a mounting element attached to said sleeve; wherein said sleeve is arranged to extend through a slag layer (24) and down into molten metal (17); and means (31) provided for supplying protective gas to an annular gap between the stopper rod (16) and the sleeve (30) for preventing air from being drawn into the annular gap.

2. The arrangement as claimed in claim 1, wherein said arrangement is provided for continuous casting of steel.

* * * * *